United States Patent [19]

Baumann

[11] Patent Number: 5,074,163

[45] Date of Patent: Dec. 24, 1991

[54] PEDAL FOR A MOTOR VEHICLE

[75] Inventor: Hans-Uwe Baumann, Stuttgart, Fed. Rep. of Germany

[73] Assignee: Dr. Ing. h. c. F. Porsche AG, Fed. Rep. of Germany

[21] Appl. No.: 498,694

[22] Filed: Mar. 26, 1990

[30] Foreign Application Priority Data

Mar. 25, 1989 [DE] Fed. Rep. of Germany ..... 3909941

[51] Int. Cl.[5] ..... G05G 1/14

[52] U.S. Cl. ..... 74/512; 74/560; 192/995

[58] Field of Search ..... 74/512, 560; 192/995

[56] References Cited

U.S. PATENT DOCUMENTS

| | | | |
|---|---|---|---|
| 2,299,508 | 10/1942 | Skareen | 74/512 X |
| 2,309,454 | 1/1943 | Heller | 74/512 X |
| 2,935,895 | 5/1960 | Krause | 74/512 |
| 3,429,008 | 2/1969 | Bud | 18/42 |
| 3,744,340 | 7/1973 | Peterson | 74/560 |
| 4,386,537 | 1/1983 | Lewis | 74/512 |
| 4,598,457 | 7/1986 | Kiwah et al. | 29/411 |
| 4,779,713 | 10/1988 | Tomala et al. | 74/512 |
| 4,846,012 | 7/1989 | Papenhagen et al. | 74/512 |
| 4,896,736 | 1/1990 | Smith | 74/512 |

FOREIGN PATENT DOCUMENTS

| | | |
|---|---|---|
| 3427097 | 1/1986 | Fed. Rep. of Germany . |
| 8614205 | 9/1986 | Fed. Rep. of Germany . |
| 2041471 | 9/1980 | United Kingdom . |

OTHER PUBLICATIONS

One Sheet from the European Patent Office.

*Primary Examiner*—Allan D. Herrmann
*Assistant Examiner*—Winnie Yip
*Attorney, Agent, or Firm*—Evenson, Wands, Edwards, Lenahan & McKeown

[57] ABSTRACT

A plastic pedal for a motor vehicle (e.g. a clutch pedal), has a stepping plate portion at the front end of the pedal arm and a spring lever with bearing bores at a rear end. The pedal arm consists of a hollow profile having a rectangular cross-section and is provided with walls 15, 17 and 24 of approximately the same thickness and constructed to have smooth surfaces on the inside and on the outside. This type of a pedal has a low weight, takes up little space and has considerably stiffness, whereby relatively high torsional and bending stress can be absorbed.

17 Claims, 2 Drawing Sheets

PEDAL FOR A MOTOR VEHICLE

BACKGROUND AND SUMMARY OF THE INVENTION

The invention relates to a plastic pedal for a motor vehicle such as a clutch pedal. The pedal includes a stepping plate portion in one piece with, and at the front end of, a pedal arm. The pedal arm has a spring lever portion with bearing bores at its rear end and the spring lever faces in a direction away from the stepping plate.

DE-A 34 27 097 shows a plastic clutch pedal for a motor vehicle with a pedal arm that is made in one piece and has ribbings arranged between two webs. These ribbings have the purpose of providing a required stiffness and absorbing the relatively high torsional and bending stresses to which the pedal is subjected during its operation. In order to meet these requirements, a pedal arm provided with a ribbing must be constructed to be very massive which results in an increase in weight and a pedal with large measurements.

The invention has an object the providing of a clutch pedal for a motor vehicle which is low in weight and one which is small in construction and high in stiffness.

According to the invention, this object is achieved by the pedal arm along its longitudinal axis consisting of a hollow profile of a polygonal cross-section with walls of approximately the same thickness which are constructed with smooth surfaces on the inside and on the outside.

It is also advantageous if, the hollow profile is constructed to have a rectangular cross-section and with a first portion extending from a bearing bore at the rear arm end to join a second portion that contains a stepping plate at the front arm end. The two portions taper until they reach a bend at the joining location.

It is also advantageous if the stepping plate forms a part of the front face wall of the hollow profile and has reinforcing ribs which are arranged above one another at the side wall to extend longitudinally with respect to the driving direction at the vehicle and which are connected with the stepping plate.

Ideally the first portion of the pedal arm has a transversely extending bearing bore for an input cylinder of the clutch. The bore is located adjacent through-opening at the rear wall of the hollow profile. The spring lever consists of a support with a U-profile-shaped cross-section which has transversely extending reinforcing ribs between its legs. The bearing bore is arranged between one reinforcing rib and the rear wall of the hollow profile and is provided with an extension sleeve at one side wall. The extension sleeve has radial reinforcing ribs supported at the side wall.

For structural strength, a transition of the first section of the pedal arm to the bend area of the spring lever and the transition of the pedal arm to the second section, each have a rounded portion respectively. Also, a surrounding internal rib is arranged in the hollow profile in the area of the bend.

It is also advantageous if the hollow profile of the pedal arm is open at its free ends and if the front arm end carrying the stepping plate is constructed to have a cross-section in the shape of a U-profile. The web of this U-profile forms a part of the stepping plate and its legs represent side walls of the hollow profile of the pedal arm.

The principal advantages achieved by mean of the invention are that a pedal is provided which is easy to manufacture according to an injection-molding method and which, because of its construction as a hollow rectangular cross-sectional profile, has such a stiffness that a bending yielding of the pedal arm is prevented even in the case of non-uniform and violent stress. As a result of the hollow profile rectangular cross-section construction relatively high torsional and bending stresses are absorbed.

Because of its small mass, the hollow profile is light and may be constructed to take up little space corresponding to available space conditions.

It is cost-effective to construct the pedal of a plastic material because during the injection molding process only two cores are used to form the two sections of the pedal arm. The two cores meet in an injection mold at the bend between the upper and lower portions of the pedal arm.

The hollow profile has a rectangular cross-section and is provided with walls of approximately the same thickness which are constructed with smooth surfaces on the inside and on the outside and which also have molded-on parts for bearings and recesses.

A stepping plate is molded on (at the end side of the pedal arm) and forms part of the hollow profile. The stepping plate is provided with reinforcing ribs to support itself at the profile in order to prevent a breaking-off of the stepping plate. A spring arm is molded onto the other end of the pedal arm to face away from the stepping plate surface. This spring arm comprises a forked end with a bearing bore.

A pedal arm made of a plastic material may be supplied for different vehicle types, since bores or openings are provided in the pedal arm and thus a pedal is created of one piece without any additional expenditures. Such a pedal arm can be used in multiple ways and significantly facilitates stock of vehicle parts.

Other objects, advantages and novel features of the present invention will become apparent from the following detailed description of the invention when considered in conjunction with the accompanying drawings.

DETAILED DESCRIPTION OF THE DRAWINGS

The pedal 1 for a motor vehicle essentially comprises a pedal arm 2 having a bearing plate 3 and a spring lever 4. It consists of a plastic material and is produced in one piece according to the injection molding method from a fiber glass reinforced polyamide.

Figure 1:
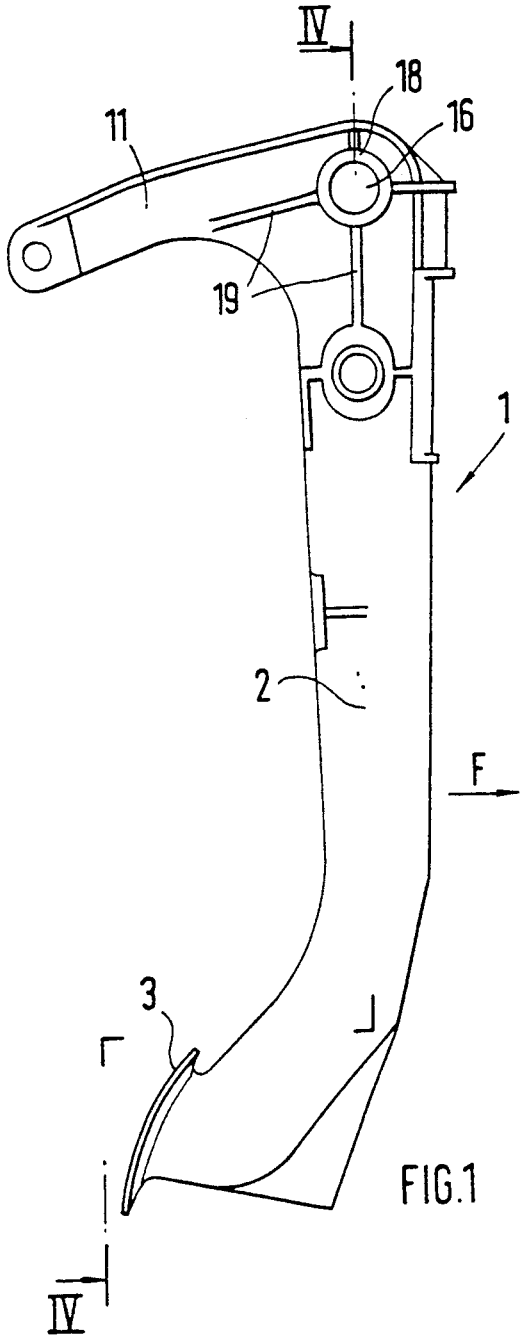
FIG. 1 is a right lateral view of the pedal of the invention taken along the motor vehicle driving direction F.
Figure 2:
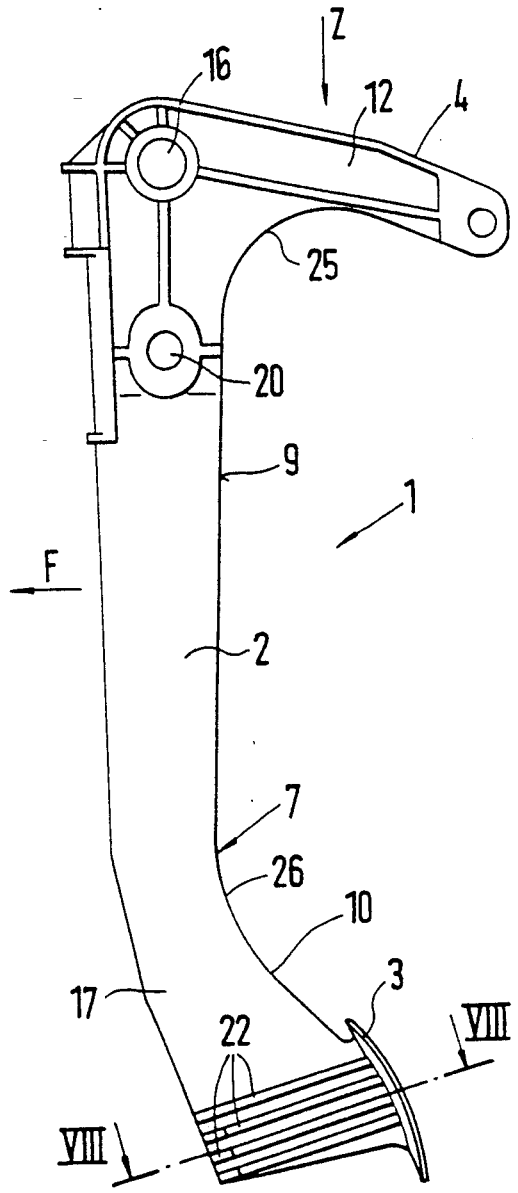
FIG. 2 is a left lateral view o the pedal taken along the driving direction.
Figure 3:
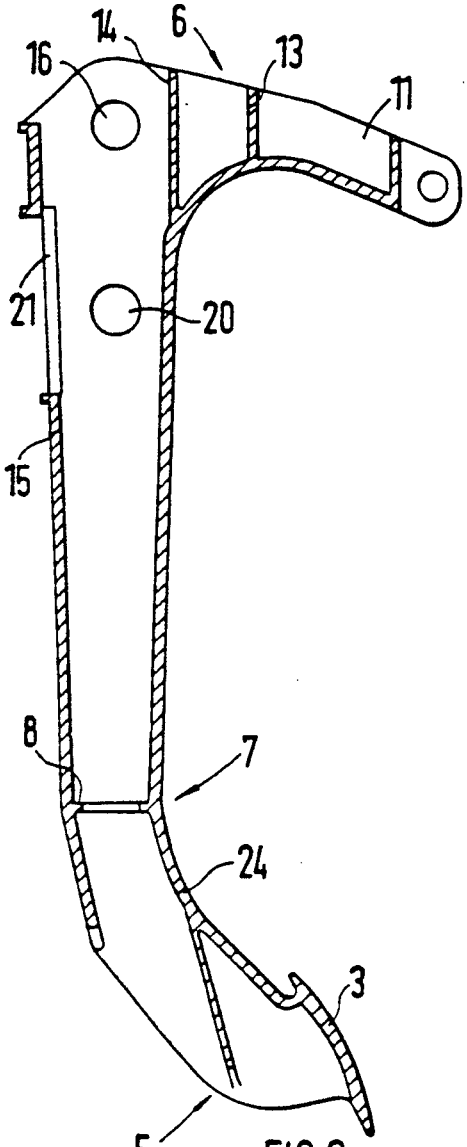
FIG. 3 is a sectional view of the pedal according to FIG. 2 taken along line III—III of FIG. 4.
Figure 4:
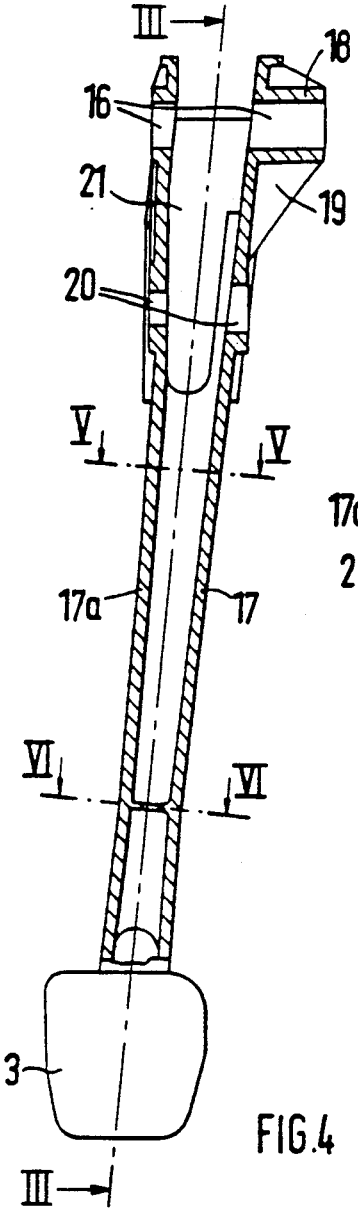
FIG. 4 a sectional view of the pedal according to Line IV—IV of FIG. 1.
Figure 5:
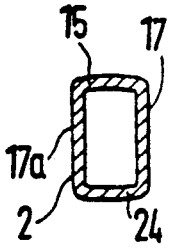
FIG. 5 is a sectional view according to Line V—V of FIG. 4.
Figure 6:
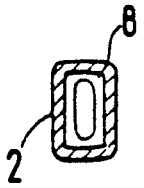
FIG. 6 is a sectional view according to Line VI—VI of FIG. 4.

The pedal arm 2 comprises a hollow profile (for example, a rectangular cross-section) which extends along its longitudinal axis from the front arm end 5 with its stepping plate 3 to the rear arm end 6 with the spring lever 4. The arm 2 comprises two sections 9, 10 which join each other at a bend 7 and are tapered. A surrounding inner rib 8 is formed on the interior of the hollow profile in the area where these two sections 5 and 6 come together. This construction of the pedal arm 2 results in a relatively large cross-section of the pedal arm in the area of high stress and allows the pedal 1 to be molded by two cores, wherein each core transverses the same length to the rib 8 and are inserted into one another at this point. As shown in FIGS. 3 and 4 the walls of the hollow profile are constructed to continuously have the same approximate thickness and largely have a smooth surface on the inside and on the outside. The outer surface may have reinforcing ribbings as well as molded-on parts.

Figure 7:
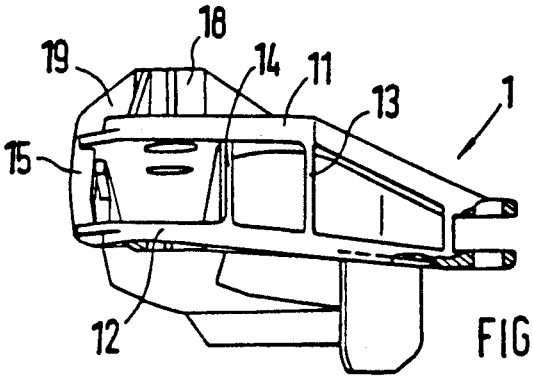
FIG. 7 is a view of the pedal according to FIG. 2 in the direction of the arrow Z.

At its rear arm end 6, the first section 9 of the pedal arm 2 has a spring lever 4 which is arranged in a bent manner with respect to the straight pedal arm 2. This spring lever 4 has a U-shaped cross-section and has transversely extending reinforcing ribs 13, 14 between its longitudinal legs 11 and 12 (FIG. 7). A transversely extending bearing bore 16 is arranged between the rib 14 and a rear wall 15 of the hollow profile created by the U-shape. This bearing bore 16 is continued to define a sleeve 18 molded to a side wall 17, 17*a* of the pedal arm 2. This sleeve 18 is supported by radial reinforcing ribs 19 in the direction of the pedal arm 2.

Two additional transversely extending bores 20 with the same axis are provided in the side walls 17, 17*a* of the first section 9 at a point below the bearing bore 16 in the pedal arm 2. Opening 21 for connecting a pressure rod to an input cylinder of a clutch (not shown) is located in the rear wall 15.

Figure 8:
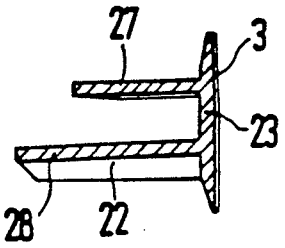
FIG. 8 a sectional view according to Line VIII—VIII of FIG. 2.

The front end 5 of the pedal arm 2 carries a stepping plate 3 which is supported with respect to a side wall 17 of the pedal 1 by ribs 22. These ribs 22 extend in longitudinal direction with respect to the driving direction F and are arranged one above the other in a spaced manner. As shown in detail in FIG. 8, the front end 5 has a cross-section which is constructed in the shape of a U-profile, with a web 23 part of the stepping plate 3 extending between two side walls 27, 28 and forming the front wall 24 (FIG. 3) of the hollow profile.

The hollow profile is left open at its respective free ends 5 and 6 and has a rounded portion 26 between the first section 9 and the second section 10 at the bend 7. Another rounded portion 25 is provided between the spring lever 4 and the first section 9 of the pedal arm 2.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A plastic pedal for a motor vehicle, comprising:

a stepping plate formed in one piece with a pedal arm;

wherein the stepping plate is formed at a front end of the arm;

wherein the pedal arm along its longitudinal axis also includes a spring lever portion at a rear end;

wherein the spring lever portion has bearing bores at an end thereof which faces away from the stepping plate;

wherein the pedal arm has a hollow profile of a polygonal cross-section with walls of approximately the same thickness;

wherein inside and outside surfaces of the walls are constructed with smooth surfaces;

wherein the hollow profile walls includes sidewalls, wherein the stepping plate includes a front face wall, wherein the stepping plate forms part of the front face wall;

wherein reinforcing ribs are connected to one of the side walls and to the front face wall of the stepping plate; and wherein the ribs are arranged one above the other at one of the side walls and extend longitudinally with respect to a driving direction of the vehicle.

2. A pedal according to claim 1, wherein the hollow profile is constructed to have a rectangular cross-section;

wherein the pedal arm has a first portion that extends from a bearing bore at the rear arm end with a taper toward a bend which connects a second portion of a arm to the first portion; and wherein the second portion supports the stepping plate.

3. A pedal according to claim 2, wherein the first portion of the pedal arm has a transversely extending bearing bore located in an opening at a rear wall of the hollow profile for attachment to a pedal output.

4. A pedal according to claim 3, wherein the spring lever portion consists of a support member with a U-profile-shaped cross-section, which has transversely extending reinforcing ribs extending between its legs;

wherein the bearing bores include a bearing bore arranged between one of said reinforcing ribs and a rear wall of the hollow profile;

wherein this bearing bore has a side extension sleeve located adjacent a side wall of the pedal arm; and wherein the extension sleeve has radical reinforcing ribs supported at the side wall of the pedal arm.

5. A pedal according to claim 3, wherein a connection of the first portion of the pedal arm to the spring lever and the connection of the first portion to the second portion each have a rounded portion.

6. A pedal according to claim 2, wherein the spring lever portion consists of a support member with a U-profile-shaped cross-section, which has transversely extending reinforcing ribs extending between its legs;

wherein one of the bearing bores is a bearing bore arranged between one of said reinforcing ribs and a rear wall of the hollow profile;

wherein this bearing bore has a side extension sleeve located adjacent a side wall of the pedal arm; and wherein the extension sleeve has radical reinforcing ribs supported at the side wall of the pedal arm.

7. A pedal according to claim 2, wherein a connection of the first portion of the pedal arm to the spring lever and the connection of the first portion to the second portion each have a rounded portion.

8. A pedal according to claim 2, wherein a surrounding internal rib is arranged in the hollow profile of the pedal arm in the area of the bend.

9. A pedal according to claim 1, wherein the first portion of the pedal arm has a transversely extending bearing bore located in an opening at a rear wall of the hollow profile for attachment to a pedal output.

10. A pedal according to claim 9, wherein the spring lever portion consists of a support member with a U-profile-shaped cross-section, which has transversely extending reinforcing ribs extending between its legs;

wherein the bearing bores include a bearing bore arranged between one of said reinforcing ribs and a rear wall of the hollow profile;

wherein this bearing bore has a side extension sleeve located adjacent a side wall of the pedal arm;

and wherein the extension sleeve has radical reinforcing ribs supported at the side wall of the pedal arm.

11. A pedal according to claim 1, wherein the spring lever portion consists of a support member with a U-profile-shaped cross-section, which has transversely extending reinforcing ribs extending between its legs;

wherein one of the bearing bores is a bearing bore arranged between one of said reinforcing ribs and a rear wall of the hollow profile;

wherein this bearing bore has a side extension sleeve located adjacent a side wall of the pedal arm; and wherein the extension sleeve has radial reinforcing ribs supported at the side wall of the pedal arm.

12. A pedal according to claim 1, wherein a connection of a first portion of the pedal arm to the spring lever and a connection of the first portion to a second portion each have a rounded portion; and, said second portion supports the stepping plate.

13. A pedal according to claim 3, wherein the hollow profile of the pedal arm, has open free ends;

wherein the front arm end of the pedal arm that carries the stepping plate is constructed to have a cross-section in the shape of a U-profile;

wherein a web of the U-profile forms a part of the stepping plate; and wherein legs of the U-profile represent side walls of the hollow profile.

14. A plastic pedal for a motor vehicle, comprising:

a stepping plate formed in one piece with a pedal arm;

wherein the stepping plate is formed at a front end of the arm;

wherein the pedal arm also includes a spring lever portion at a rear end;

wherein the spring lever portion has bearing bores at an end thereof which faces away from the stepping plate;

wherein the pedal arm along its longitudinal axis has a hollow profile of a polygonal cross-section with walls of approximately the same thickness; wherein inside and outside surfaces of the walls are constructed with smooth surfaces;

wherein the spring lever portion consists of a support member with a U-profile-shaped cross-section, which has transversely extending reinforcing ribs extending between its legs;

wherein the bearing bores include a bearing bore arranged between one of said reinforcing ribs and a rear wall of the hollow profile;

wherein this bearing bore has a side extension sleeve located adjacent a side wall of the pedal arm; and wherein the extension sleeve has radical reinforcing ribs supported at the side wall of the pedal arm.

15. A plastic pedal for a motor vehicle, comprising:

a stepping plate formed in one piece with a pedal arm that has a front arm end;

wherein the stepping plate is formed at the front arm end of the pedal arm;

wherein the pedal arm also includes a spring lever portion at a rear end;

wherein the spring lever portion has bearing bores at an end thereof which faces away from the stepping plate;

wherein the pedal arm along its longitudinal axis has a hollow profile of a polygonal cross-section with walls of approximately the same thickness; and wherein inside and outside surfaces of the walls are constructed with smooth surfaces, wherein the hollow profile of the pedal arm, has open free ends;

wherein the front arm end of the pedal arm that carries the stepping plate is constructed to have a cross-section in the shape of a U-profile;

wherein a web of the U-profile forms a part of the stepping plate; and wherein legs of the U-profile represent side walls of the hollow profile and merge with the web forming part of the stepping plate.

wherein the front arm end of the pedal arm that carries the stepping plate is constructed to have a cross-section in the shape of a U-profile;

wherein a web of the U-profile forms a part of the stepping plate; and wherein legs of the U-profile represent side walls of the hollow profile.

16. A pedal according to claim 15, wherein the legs of the U-profile extend in planes parallel to a travel path of the pedal arm during use thereof.

17. A pedal according to claim 15, wherein the hollow profile is constructed to have a rectangular cross-section;

wherein the pedal arm has a first portion that extends from a bearing bore at the rear arm end with a taper toward a bend which connects a second portion of the arm to a first portion; and wherein the second portion supports the stepping plate.

* * * * *